US009033264B2

(12) United States Patent
Stier

(10) Patent No.: US 9,033,264 B2
(45) Date of Patent: May 19, 2015

(54) FUEL INJECTOR AND METHOD FOR ASSEMBLING A FUEL INJECTOR

(75) Inventor: Hubert Stier, Vaihingen/Enz (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1223 days.

(21) Appl. No.: 11/238,507

(22) Filed: Sep. 28, 2005

(65) Prior Publication Data

US 2006/0071103 A1 Apr. 6, 2006

(30) Foreign Application Priority Data

Sep. 28, 2004 (DE) ..... 10 2004 047 040

(51) Int. Cl.

| | |
|---|---|
| ***F02M 61/00*** | (2006.01) |
| ***F02M 51/06*** | (2006.01) |
| ***F02M 61/16*** | (2006.01) |
| *F02M 51/00* | (2006.01) |

(52) U.S. Cl.

CPC ..... *F02M 51/0667* (2013.01); *F02M 51/005* (2013.01); *F02M 61/168* (2013.01)

(58) Field of Classification Search

CPC F02M 61/168; F02M 51/0667; F02M 51/005

USPC ..... 239/88–92, 585.1–585.5, 533.2; 251/129.21

See application file for complete search history.

(56) References Cited

U.S. PATENT DOCUMENTS

| | | | | |
|---|---|---|---|---|
| 4,944,486 | A * | 7/1990 | Babitzka | 251/129.21 |
| 5,185,919 | A * | 2/1993 | Hickey | 29/602.1 |
| 6,012,655 | A * | 1/2000 | Maier | 239/585.4 |
| 6,481,646 | B1 * | 11/2002 | Hornby | 239/585.1 |

FOREIGN PATENT DOCUMENTS

| | | |
|---|---|---|
| DE | 197 12 591 | 10/1998 |
| DE | 101 22 353 | 11/2002 |
| EP | 1 219 815 | 7/2002 |
| EP | 1 245 828 | 10/2002 |
| EP | 1 264 984 | 12/2002 |
| JP | 61-272320 | 12/1986 |
| JP | 11-51301 | 11/1999 |
| JP | 2002-180926 | 6/2002 |
| JP | 2002-213318 | 7/2002 |
| WO | WO 89/05861 | 6/1989 |

* cited by examiner

*Primary Examiner* — Jason Boeckmann
(74) *Attorney, Agent, or Firm* — Kenyon & Kenyon LLP

(57) ABSTRACT

A fuel injector for fuel injection systems of internal combustion engines has a solenoid operable via an electric wire, a valve sleeve in an injection-side area forming an external sheathing of the fuel injector, and a valve housing. The fuel injector has a plastic sleeve, which contains the solenoid and the electric wire and can be pushed onto the valve sleeve.

13 Claims, 3 Drawing Sheets

FUEL INJECTOR AND METHOD FOR ASSEMBLING A FUEL INJECTOR

FIELD OF THE INVENTION

The present invention is directed to a fuel injector and a method for assembling a fuel injector.

BACKGROUND INFORMATION

Fuel injectors normally have a number of metallic housing parts, which are provided with a plastic coating after assembly. German Published Patent Application No. 101 22 353, for example, describes a fuel injector of this type.

German Published Patent Application No. 197 12 591 also describes a fuel injector which is composed of two pre-assembled independent modules. A function part essentially includes an electromagnetic circuit and a sealing valve, while a connecting part essentially comprises a hydraulic connector and an electric connector. In the fully assembled fuel injector, electric connecting elements and hydraulic connecting elements of the two modules cooperate in such a way as to ensure the electric and hydraulic connection.

The disadvantage of the known fuel injectors is in particular that the assembly of such a fuel injector is made complicated and cost-intensive by the plastic coating.

Furthermore, when coating with liquid plastic, components are shifted from their original positions, which increases the reject rate in the manufacture of the fuel injectors.

SUMMARY OF THE INVENTION

The fuel injector according to the present invention and the method according to the present invention for assembling a fuel injector have the advantage over the related art that the fuel injector may be assembled from two modules without the need for complicated connecting elements by inserting a hydraulic cartridge into a pre-manufactured plastic sleeve.

Quicker assembly is thus possible in fewer work steps, and the expensive plastic coating, which is subject to defects, may be omitted. In addition, the individual modules may be manufactured in a simple way because they contain no complicated components.

The plastic sleeve advantageously includes the hydraulic and electric connection, as well as the solenoid and its electric contact wire, while the hydraulic module includes the remaining components forming the magnetic circuit and the valve.

It is furthermore advantageous that the hydraulic module is situated in a preferably deep-drawn pipe.

It is also advantageous that the pipe has a peripheral groove and a sealing ring, which forms a seal between an outer wall of the hydraulic module and an inner wall of the plastic sleeve.

The hydraulic module is advantageously fixed, after insertion into the plastic sleeve, by clamping action; however, it may be additionally secured by gluing.

DETAILED DESCRIPTION

Figure 1:
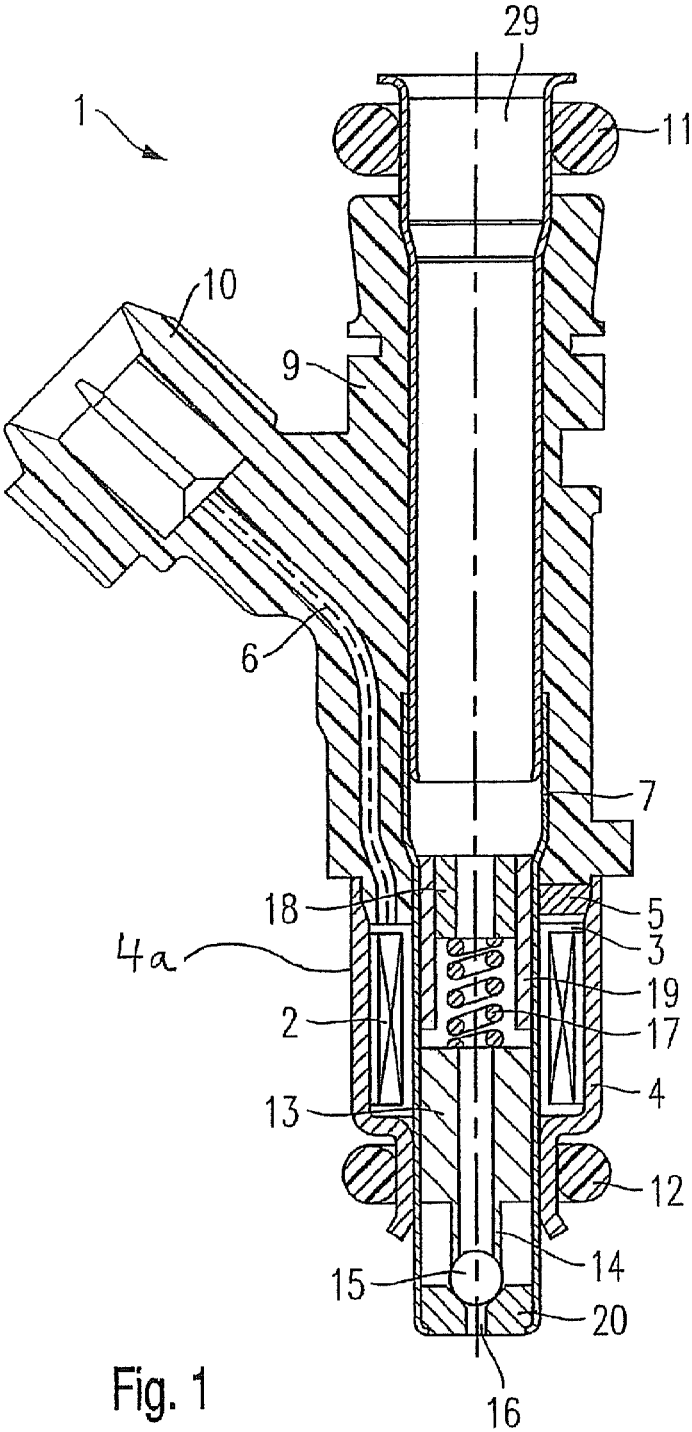
Fig. 1 Related Art
FIG. 1 schematically shows a longitudinal section through an example of a fuel injector according to the related art.

FIG. 1 first shows, to better illustrate the measures according to the present invention, a highly simplified sectional view of the essential components of a fuel injector 1 according to the related art. Fuel injector 1 is suitable in particular for injecting fuel into an inlet pipe (not illustrated in detail) of an internal combustion engine.

Fuel injector 1 includes a solenoid 2, which is wound onto a field spool 3. Field spool 3 is encapsulated in a valve housing 4, which is used as the external pole 4*a* of solenoid 2 and is closed by a cover 5. Solenoid 2 is contacted by an electric wire 6. A tube-shaped valve sleeve 7, which is extended by an insert sleeve 8 for supplying fuel, goes through field spool 3.

Fuel injector 1 is assembled according to the related art in such a way that valve sleeve 7 is manufactured first and provided with insert sleeve 8, and subsequently the components solenoid 2, valve housing 4, and cover 5 are axially pushed onto valve sleeve 7 of fuel injector 1. After pre-assembly, a plastic sheathing 9 is extruded onto the metallic components of fuel injector 1. It includes a connector 10 for connecting the electric lead (not shown) for solenoid 2.

On the inlet side, fuel injector 1 is sealed off from the fuel distribution line (not shown) by a seal 11 and, on the downstream side, from the inlet pipe of the engine by another seal 12.

Fuel injector 1 may be operated, for example, via an armature 13 cooperating with solenoid 2, in conjunction with a valve needle 14, whose valve closing body 15 closes an injection opening 16. Injection opening 16 is opened by lifting valve needle 14 and is closed by re-lowering valve needle 14 with the help of a restoring spring 17, for example, which is pre-stressed by an adjusting sleeve 18. An internal pole 19 of the solenoid is pressed into valve sleeve 7.

The above-mentioned components must be installed in valve sleeve 7 individually and in a given sequence for assembling fuel injector 1. Internal pole 19 must be inserted first, then adjusting sleeve 18, restoring spring 17, and finally armature 13 including valve needle 14 and valve closing body 15. A valve seat body 20 having injection opening 16 is finally inserted into valve sleeve 7.

Figure 2A:
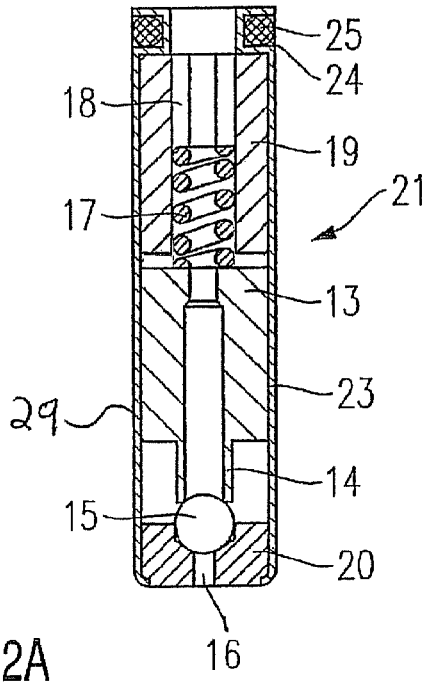
FIG. 2A shows a schematic illustration of a hydraulic cartridge for use in a fuel injector according to the present invention.
Figure 2B:
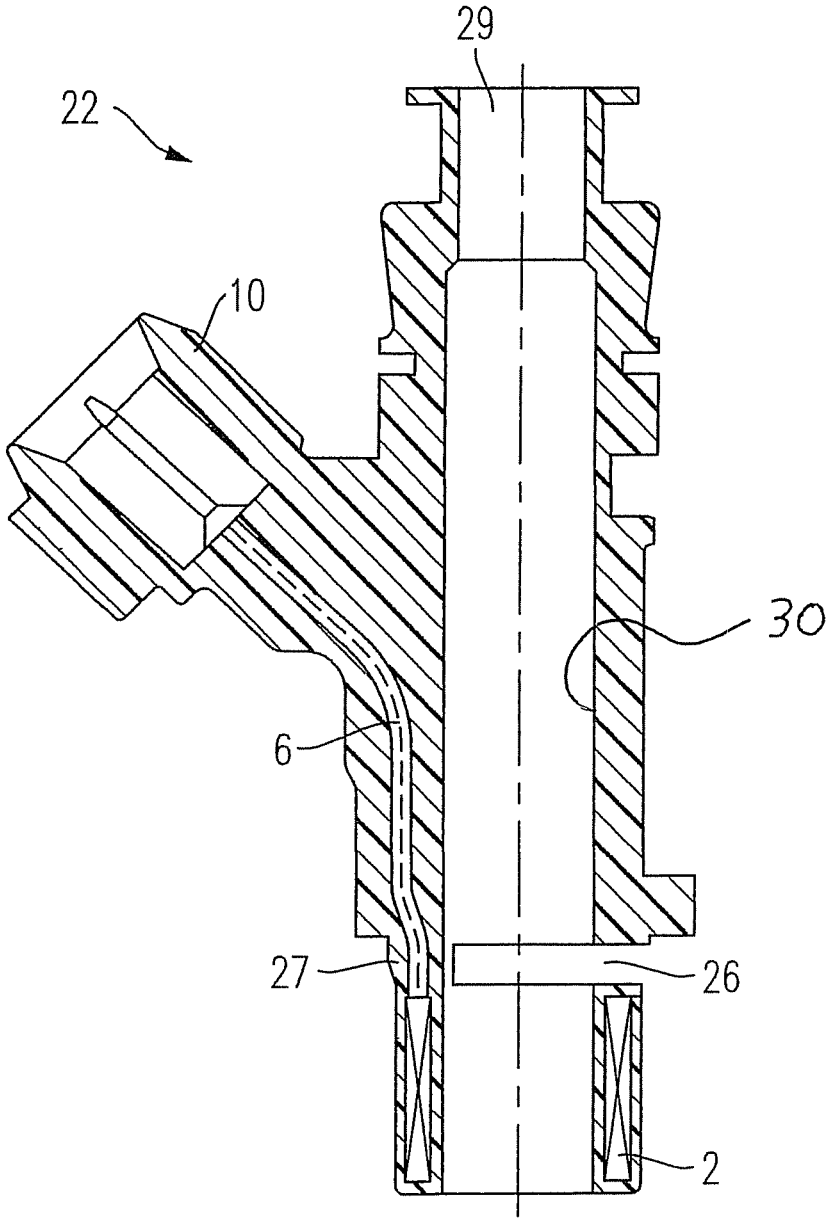
FIG. 2B shows a schematic illustration of a plastic sleeve for use in a fuel injector according to the present invention.
Figure 2C:
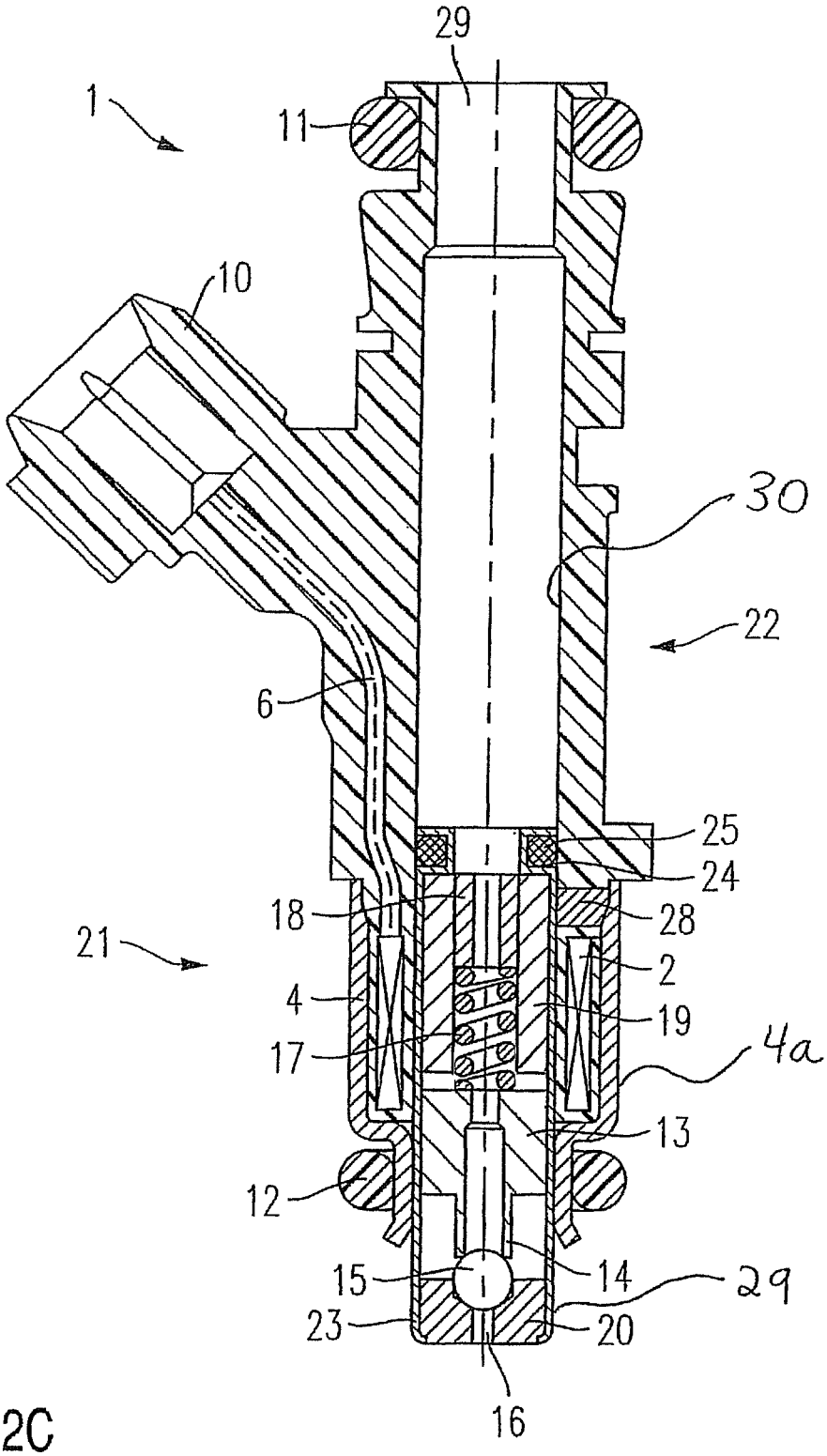
FIG. 2C shows a schematic illustration of an exemplary embodiment of a fully assembled fuel injector according to the present invention.

As schematically shown in FIGS. 2A through 2C, the assembly of fuel injector 1 is simplified according to the present invention in that first a plastic sleeve 22 is manufactured, which already includes solenoid 2 and the required electric contact wiring 6 and plug 10, which are then provided with a hydraulic module 21 of fuel injector 1 in an additional assembly step.

Hydraulic module 21 is schematically illustrated in FIG. 2A. It includes a pipe 23, into which internal pole 19, adjusting sleeve 18, restoring spring 17, the component which includes armature 13, valve needle 14 and valve closing body 15, and finally valve seat body 20 having injection opening 16 are installed. This latter component is responsible for preventing the individual components from falling out of pipe 23.

On the inlet side, pipe 23 has a peripheral groove 24, in which a sealing ring 25 for forming a seal between an outer wall 29 of hydraulic module 21 and an inner wall 30 of plastic sleeve 22 is situated. Pipe 23 is manufacturable in a simple way, for example, as a deep-drawn part. Hydraulic module 21 is compact, easy to assemble, and reliable, being transportable in bulk without risk of damage.

Plastic sleeve 22 is schematically illustrated in FIG. 2B. It already has plug 10 molded onto it, a hydraulic connection 29 for connecting to a fuel distribution line (not shown), electric wiring 6 and solenoid 2. On the inlet side of solenoid 2, a recess 26 is formed, which divides plastic sleeve 22 into two parts, which are connected by a web 27. Electric wiring 6 for contacting solenoid 2 is located in web 27.

A cover 28 is provided for further assembling fuel injector 1 as shown in FIG. 2C. Cover 28 is radially snapped over hydraulic module 21 of fuel injector 1 during assembly.

The assembly of fuel injector 1 includes the following steps: inserting pre-assembled hydraulic module 21 into the likewise pre-manufactured plastic sleeve 22, radially pushing cover 28 into recess 26, and finally fitting valve housing 4 onto hydraulic module 21. As an alternative, hydraulic module 21 may also be connected to plastic sleeve 22 by gluing.

Assembly may thus be kept very simple without welding, soldering, or other joining procedures. Nevertheless, hydraulic module 21 is reliably and hermetically connected to plastic sleeve 22. Complicated connections and connecting components for electrically and hydraulically connecting the two modules may be omitted in full.

The present invention is not limited to the exemplary embodiment illustrated and may be applied to any other types of fuel injector 1, e.g., to fuel injectors 1 for direct injection or to fuel injectors 1 in conjunction with a common rail system. In particular, any combinations of the individual features are possible.

What is claimed is:

1. A fuel injector for a fuel injection system of an internal combustion engine, comprising:

an electromagnetic circuit including at least one solenoid, an internal pole, and an external pole;

a valve needle movable in the electromagnetic circuit;

a valve closing body that is part of the valve needle;

an electric connection;

a hydraulic connection for connecting to a fuel distribution line;

a plastic sleeve into which the at least one solenoid, the electric connection, and the hydraulic connection are formed in the plastic sleeve, wherein the hydraulic connection is formed as part of the plastic sleeve; and a hydraulic module comprising the internal pole, the valve needle and a pipe in which the internal pole and the valve needle are situated, wherein the pipe surrounds the hydraulic module along its entire axial length, wherein the hydraulic module is insertable into the plastic sleeve, into an operating position of the hydraulic module inside the plastic sleeve; wherein a sealing ring forms a seal between an outer circumferential wall of the hydraulic module and an inner circumferential wall of the plastic sleeve, the sealing ring situated in a peripheral groove disposed on an upper edge of an inlet-side end of the pipe.

2. The fuel injector as recited in claim 1, wherein the pipe includes a deep-drawn part.

3. The fuel injector as recited in claim 1, wherein the hydraulic module is connected to the plastic sleeve by gluing.

4. The fuel injector as recited in claim 1, wherein the plastic sleeve includes a recess.

5. The fuel injector as recited in claim 4, further comprising:

a cover that is radially insertable into the recess over the hydraulic module.

6. The fuel injector as recited in claim 5, wherein the hydraulic module is secured to the plastic sleeve by the cover.

7. The fuel injector as recited in claim 1, further comprising:

an adjusting sleeve, wherein the entire adjusting sleeve is surrounded by the pipe.

8. The fuel injector as recited in claim 1, further comprising:

an armature, wherein the armature is surrounded by the pipe.

9. The fuel injector as recited in claim 4, wherein the recess is disposed on only one side of the plastic sleeve.

10. The fuel injector as recited in claim 4, wherein the recess is formed immediately above the solenoid.

11. The fuel injector as recited in claim 4, wherein the recess is formed adjacent to an electrical wiring of the electric connection.

12. The fuel injector as recited in claim 1, wherein the sealing ring is part of the pipe.

13. The fuel injector as recited in claim 1, wherein the hydraulic connection is made of plastic.

* * * * *